US010274895B2

(12) United States Patent
Koseki

(10) Patent No.: US 10,274,895 B2
(45) Date of Patent: Apr. 30, 2019

(54) SHIELD CASE AND IMAGE FORMING APPARATUS

(71) Applicant: CANON KABUSHIKI KAISHA, Tokyo (JP)

(72) Inventor: Hiromichi Koseki, Saitama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/346,174

(22) Filed: Nov. 8, 2016

(65) Prior Publication Data

US 2017/0131680 A1 May 11, 2017

(30) Foreign Application Priority Data

Nov. 11, 2015 (JP) ..... 2015-220867

(51) Int. Cl.
*G03G 21/20* (2006.01)
*G03G 21/16* (2006.01)

(52) U.S. Cl.
CPC ..... *G03G 21/206* (2013.01); *G03G 21/1619* (2013.01)

(58) Field of Classification Search
CPC ..... G03G 21/1619; G03G 21/206
USPC ..... 399/92
See application file for complete search history.

(56) References Cited

FOREIGN PATENT DOCUMENTS

| | | | |
|---|---|---|---|
| JP | 61-51994 | A | 3/1986 |
| JP | 6-314002 | A | 11/1994 |
| JP | 2007-328531 | A | 12/2007 |
| JP | 2012-256768 | A | 12/2012 |
| JP | 2015-032681 | A * | 2/2015 |

* cited by examiner

*Primary Examiner* — Hoang X Ngo
(74) *Attorney, Agent, or Firm* — Canon U.S.A., Inc. IP Division

(57) ABSTRACT

An apparatus including a case that includes an electro conductive housing that accommodates a circuit board on which an electronic component is mounted and that includes a first opening for accommodating the circuit board, an electro conductive top plate that is disposed so as to cover the first opening and that includes a second opening, a HDD that is separated from the circuit board with the top plate and is connected to the circuit board, and a signal wire that connects the circuit board and the HDD to each other thorough the second opening. The apparatus includes an electro conductive cover to cover the HDD and the signal wire, and a duct portion formed between the electro conductive cover and the top plate and passes external air from below the HDD to the housing though the second opening.

33 Claims, 7 Drawing Sheets

SHIELD CASE AND IMAGE FORMING APPARATUS

BACKGROUND OF THE INVENTION

Field of the Invention

The aspect of the embodiments relates to an image forming apparatus including an electro conductive case that accommodates a circuit board on which an electronic component is mounted.

Description of the Related Art

Hitherto, a configuration illustrated in Japanese Patent Laid-Open No. 2012-256768 is known as an arrangement of a storage medium in a control device. Japanese Patent Laid-Open No. 2012-256768 includes a shield case body (a housing) that accommodates a circuit board on which electric components, such as a central processing unit (CPU) of a control device, are mounted and that includes an opening. Japanese Patent Laid-Open No. 2012-256768 further includes a top plate that covers the opening of the shield case body. Furthermore, in order to dispose the storage medium, a dedicated mounting structure is provided inside the shield case body.

In recent years, due to the reduction in space for the image forming apparatus, the control device in the image forming apparatus is in the process of becoming smaller.

At the same time, computer software is becoming highly functional such that the amount of heat generated by the CPU and the like is becoming larger and larger.

In order to protect storage mediums, such as hard disk drives (HDDs), that have a lower limit temperature compared to other elements from malfunctioning, measures to deal with the increase in temperature of the recording mediums inside control devices are in need.

SUMMARY OF THE INVENTION

The aspect of the embodiments is addressed to solve the above issue and provides a case capable of suppressing an increase in temperature of a storage medium.

An apparatus according to the aspect of the embodiments includes an image-forming unit configured to form an image, an electro conductive box portion in which a circuit board on which an electronic component is mounted and a storage medium that records information are accommodated, the box portion including a first storage portion in which the circuit board is accommodated, a second storage portion that is provided adjacent to the first storage portion and in which the storage medium is accommodated, and a partitioning portion that partitions the circuit board and the storage medium from each other, a communication hole that is provided above the partitioning portion and that communicates the first storage portion and the second storage portion to each other, a signal wire that connects the circuit board and the storage medium to each other through the communication hole, a first vent hole provided in the first storage portion and disposed above the storage medium, the first vent hole being in communication with external air, and a second vent hole that is provided in the second storage portion and that is in communication with the external air at a portion below the communication hole. The second storage portion forms a path that guides the external air that has flowed in through the second vent hole to the communication hole.

Furthermore, an image forming apparatus according to the aspect of the embodiments includes an image-forming unit that forms an image, an electro conducive box portion configured to accommodate a circuit board and a storage medium that records information, the box portion including a first storage portion in which the circuit board is accommodated, a second storage portion that is provided adjacent to the first storage portion and in which the storage medium is accommodated, and a partitioning portion that partitions the circuit board and the storage medium from each other, a communication hole that communicates the first storage portion and the second storage portion to each other, a signal wire that connects the circuit board and the storage medium to each other through the communication hole, a first vent hole that is provided in the first storage portion and that is in communication with external air, a second vent hole that is provided in the second storage portion and that is in communication with the external air, and a fan that blows external air into the box portion through the second vent hole and the first vent hole.

Further features of the aspect of the embodiments will become apparent from the following description of exemplary embodiments with reference to the attached drawings.

DESCRIPTION OF THE EMBODIMENTS

A shield case and an image forming apparatus provided with the shield case, according to an embodiment of the present disclosure will be described in detail with reference to the drawings.

First Exemplary Embodiment

Referring to FIGS. 1 to 6, a configuration of an image forming apparatus according to a first exemplary embodiment provided with a shield case according to the present disclosure will be described.

Image Forming Apparatus

Figure 1:
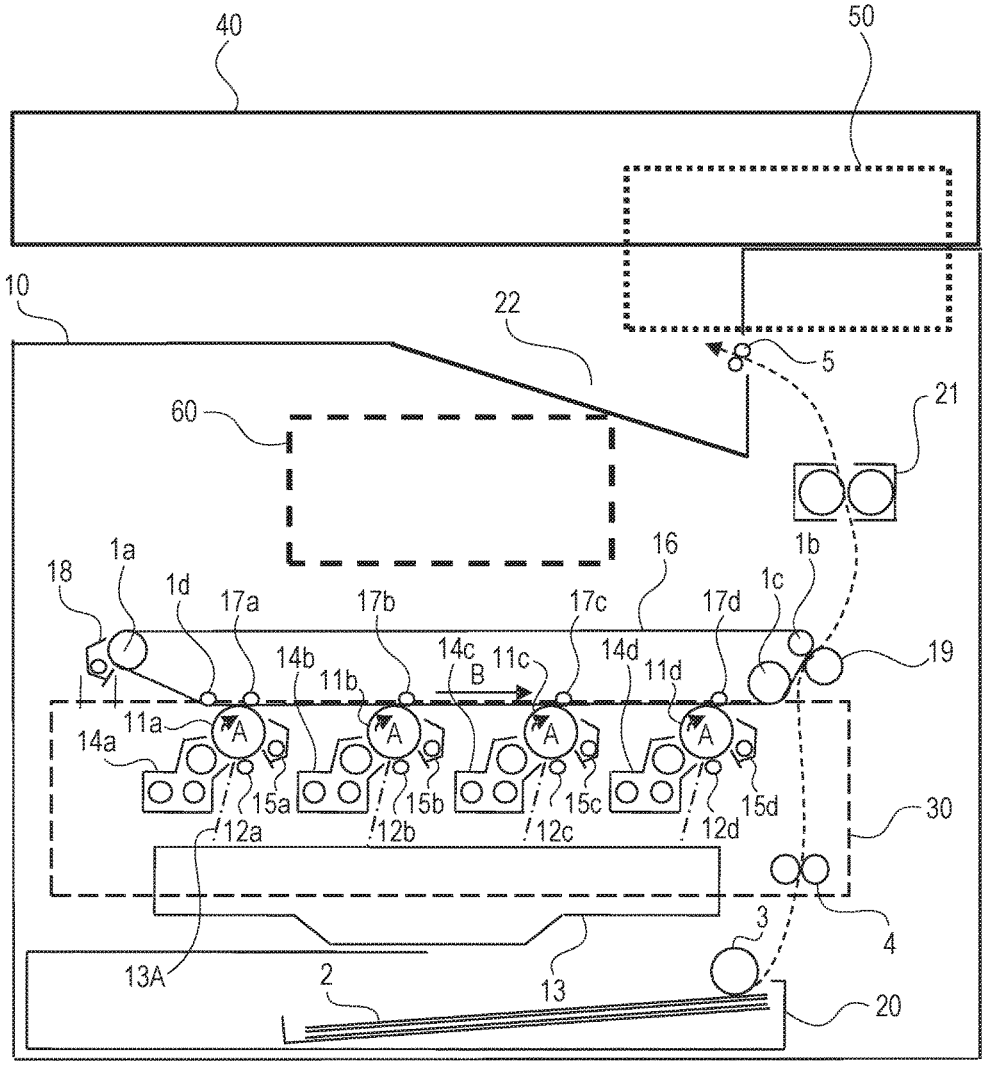
FIG. 1 is a cross-sectional view illustrating a configuration of an image forming apparatus provided with a controller covered with a shield case of a first exemplary embodiment according to the aspect of the embodiments.

FIG. 1 is a cross-sectional view illustrating a configuration of an image forming apparatus 10. In FIG. 1, reference numerals 11*a*, 11*b*, 11*c*, and 11*d* are photosensitive drums serving as image-bearing members corresponding to the colors yellow, magenta, cyan, and black, respectively. Note that for the sake of description, the description may be given using merely a photosensitive drum 11, representing the photosensitive drums 11*a*, 11*b*, 11*c*, and 11*d*. Same applies for the other members of the image forming process.

A charging device 12 serving as a charger that uniformly charges the surface of the photosensitive drum 11 is provided around the photosensitive drum 11. An image exposing device 13 serving as an image exposing member that forms an electrostatic latent image by projecting a laser beam 13A modulated on the basis of image data on a charged surface of the photosensitive drum 11 that has been uniformly charged with the charging device 12 is provided.

Furthermore, the image forming apparatus 10 includes a developing device 14 serving as a developing member that develops a toner image by supplying a developing agent to an electrostatic latent image, corresponding to the image data, formed by projecting a laser beam 13A, emitted from the image exposing device 13, on the surface of the photosensitive drum 11.

The toner image formed on the surface of the photosensitive drum 11 is primarily transferred on an outer circumferential surface of an intermediate transfer belt 16 with a primary transfer roller 17 serving as a primary transfer member. A cleaning device 15 serving as a cleaning member that subsequently cleans and collects the residual toner on the surface of the photosensitive drum 11 is provided.

A photosensitive drum 11, a charging device 12, a developing device 14, and a cleaning device 15 are constituted in an integrated manner as a process cartridge P for each color.

The intermediate transfer belt 16 on which the toner image formed on the surface of each photosensitive drum 11 is transferred is provided above each photosensitive drum 11 in FIG. 1. The intermediate transfer belt 16 is stretched by tension rollers 1*a* to 1*d* and is rotationally driven in an arrow B direction in FIG. 1.

Each primary transfer roller 17 is provided on the inner circumferential surface side of the intermediate transfer belt 16 at a position that opposes the corresponding photosensitive drum 11.

A cleaning device 18 serving as a cleaning member is provided on the outer circumferential surface side of the intermediate transfer belt 16. The toner images that have been primarily transferred onto the outer circumferential surface of the intermediate transfer belt 16 is secondarily transferred onto a recording medium 2 with a secondary transfer roller 19 serving as a secondary transfer member. Subsequently, the residual toner on the outer circumferential surface of the intermediate transfer belt 16 is collected with the cleaning device 18.

The secondary transfer roller 19 is provided on the outer circumferential surface side of the intermediate transfer belt 16 and on the opposite side with respect to the cleaning device 18 so as to face the intermediate transfer belt 16.

Meanwhile, a separating member (not shown) and a feed roller 3 working together separate and feed the recording mediums 2 sheet by sheet from a sheet cassette 20. Subsequently, the leading edge portion of the recording medium 2 abuts against a nip portion between tentatively stopped registration rollers 4, and a skew is corrected with the hardness of the recording medium 2.

The registration rollers 4 are rotationally driven at a predetermined timing synchronizing with the rotation of the toner image formed on the surface of the photosensitive drum 11. With the above, the recording medium 2 nipped between the registration rollers 4 is conveyed to the secondary transfer position formed of a nip portion between the outer circumferential surface of the intermediate transfer belt 16 and the secondary transfer roller 19.

A fixing device 21 serving as a fixing member is provided, in the conveyance direction, downstream of the recording medium 2 that has passed through the secondary transfer position between the intermediate transfer belt 16 and the secondary transfer roller 19.

The recording medium 2 to which the toner image has been fixed by heat with the fixing device 21 is nipped and conveyed by discharge rollers 5 and is discharged on a discharge tray 22.

The operation of the image forming apparatus 10 is controlled by a controller 60 serving as a control member. The controller 60 is covered by an electro conductive shield case 6 illustrated in FIGS. 3 to 6.

The residual toner collected by the cleaning devices 15 and 18 is conveyed to and collected in a waste toner box 30 disposed on the front side of the image forming apparatus 10.

Image Forming Operation

An image forming operation of the image forming apparatus 10 will be described next. The photosensitive drum 11 is rotated at a constant speed in an arrow A direction in FIG. 1 by a driving member (not shown). A laser beam 13A modulated on the basis of image data is projected from the image exposing device 13 on the surface of the photosensitive drum 11 that has been uniformly charged by the charging device 12 such that an electrostatic latent image corresponding to the image data is formed on the surface of the photosensitive drum 11.

A developing agent (toner) filled inside the developing device 14 is supplied to the electrostatic latent image formed on the surface of the photosensitive drum 11 such that a toner image is developed.

The toner images formed on the surfaces of the photosensitive drums 11 are moved, with the rotation of the photosensitive drums 11 in the arrow A direction in FIG. 1, to positions where primary transfer is performed on the intermediate transfer belt 16 that are positions where the photosensitive drums 11 opposes the primary transfer rollers 17. Then, with the function of the primary transfer rollers 17, the toner images formed on the surface of the photosensitive drums 11 are sequentially and primarily transferred onto the outer circumferential surface of the intermediate transfer belt 16 in a superimposed manner.

The residual toner on the surfaces of the photosensitive drums 11 that had, at the primary transfer positions, not been primarily transferred onto the outer circumferential surface of the intermediate transfer belt 16 is collected by the cleaning devices 15. With the above, the surfaces of the photosensitive drums 11 are cleaned by the cleaning devices 15 and are prepared for the next image formation.

The residual toner collected by the cleaning devices 15 is conveyed to and collected in the waste toner box 30.

The intermediate transfer belt 16 is rotationally driven with a driving member (not shown) at a constant speed in an arrow B direction in FIG. 1. The recording medium 2 is fed from the sheet cassette 20 at a timing in which the toner image including various colors are superimposed on the outer circumferential surface of the intermediate transfer belt 16 by rotation of the intermediate transfer belt 16 is positioned at the secondary transfer position where the secondary transfer roller 19 opposes. Furthermore, at the secondary transfer position, the toner images on the outer circumferential surface of the intermediate transfer belt 16 are collectively and secondarily transferred onto the recording medium 2 with the function of the secondary transfer roller 19.

The residual toner on the outer circumferential surface of the intermediate transfer belt 16 that has not been transferred at the secondary transfer position is collected with the cleaning device 18. The outer circumferential surface of the intermediate transfer belt 16 is cleaned by the cleaning device 18 and are prepared for the next image formation. The residual toner collected by the cleaning device 18 is conveyed to and collected in the waste toner box 30.

The recording medium 2 on which the toner image on the outer circumferential surface of the intermediate transfer belt 16 has been secondarily transferred is conveyed to the fixing device 21. The recording medium 2 onto which the toner image has been secondarily transferred is heated and compressed while being nipped and conveyed between a fixing roller and a pressure roller provided in the fixing device 21; accordingly, the toner image is melted and fixed by heat to the recording medium 2. Subsequently, the recording medium 2 is nipped and conveyed by discharge rollers 5 and is discharged on a discharge tray 22.

Figure 2:
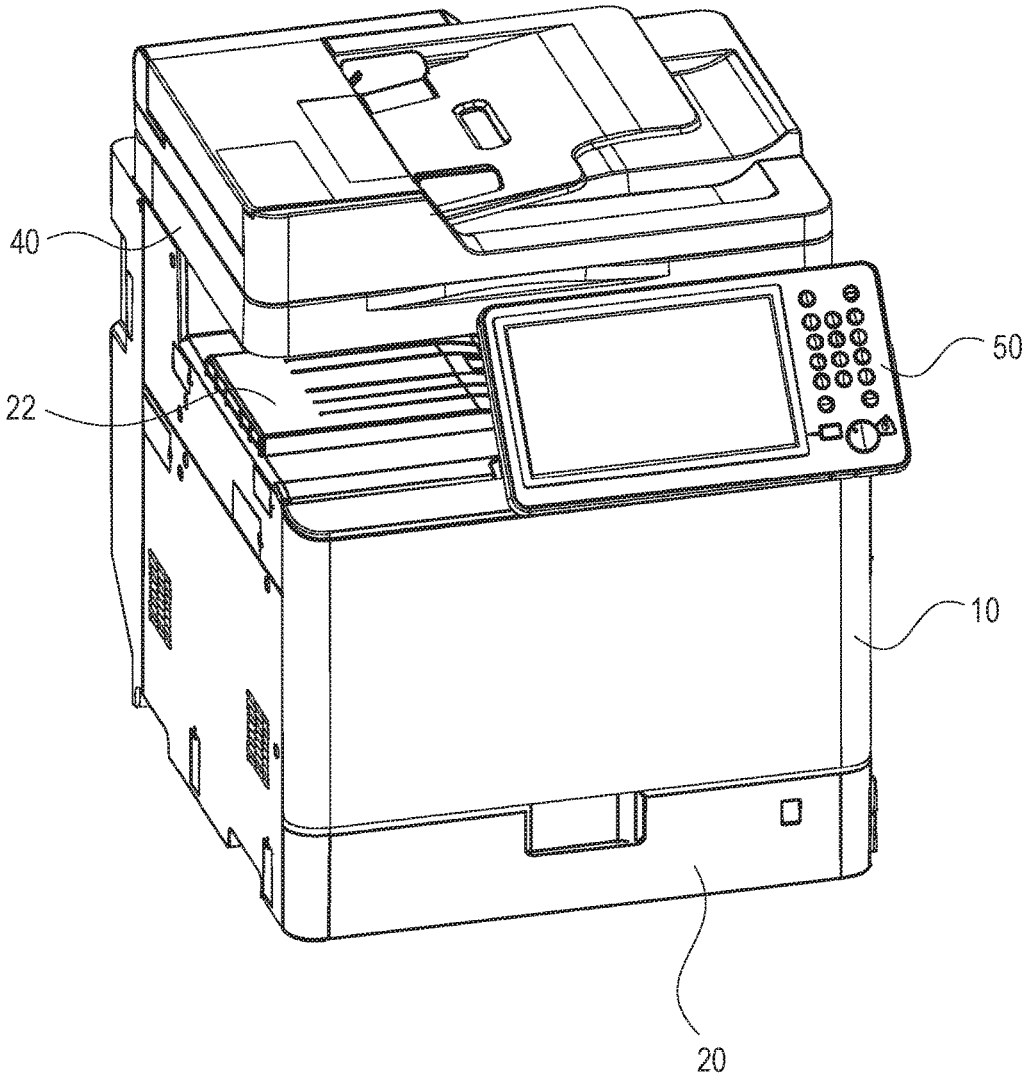
FIG. 2 is a perspective view illustrating the configuration of the image forming apparatus provided with the controller covered with the shield case of the first exemplary embodiment.

FIG. 2 is a perspective view illustrating a configuration of the image forming apparatus 10. The user uses an operation panel 50 to select the function used by the image forming apparatus 10. For example, in a case in which copying is selected, the number of copies, scaling, density, double-side printing or one-side printing, full color or monochrome, the sheet cassette 20 from which the recording medium 2 is fed, the size of the recording medium 2, whether to perform stapling (binding), and the like are selected as appropriate.

Subsequently, the user presses a start button while the original document that is the copy source is placed on a glass plate of an image scanner 40 serving as an image reading member. With the above, the image of the original document is read by the image scanner 40, the read image data is transmitted to the controller 60 and is converted into a signal for forming an image, and the image forming process described above is executed.

In a case of a printing job, an external input is directly input to the controller 60 from, for example, a personal computer (PC) and is converted into a signal for forming an image, and the image forming process described above is performed. The recording medium 2 on which the toner image has been formed is stacked on the discharge tray 22.

Shield Case

Figure 3:
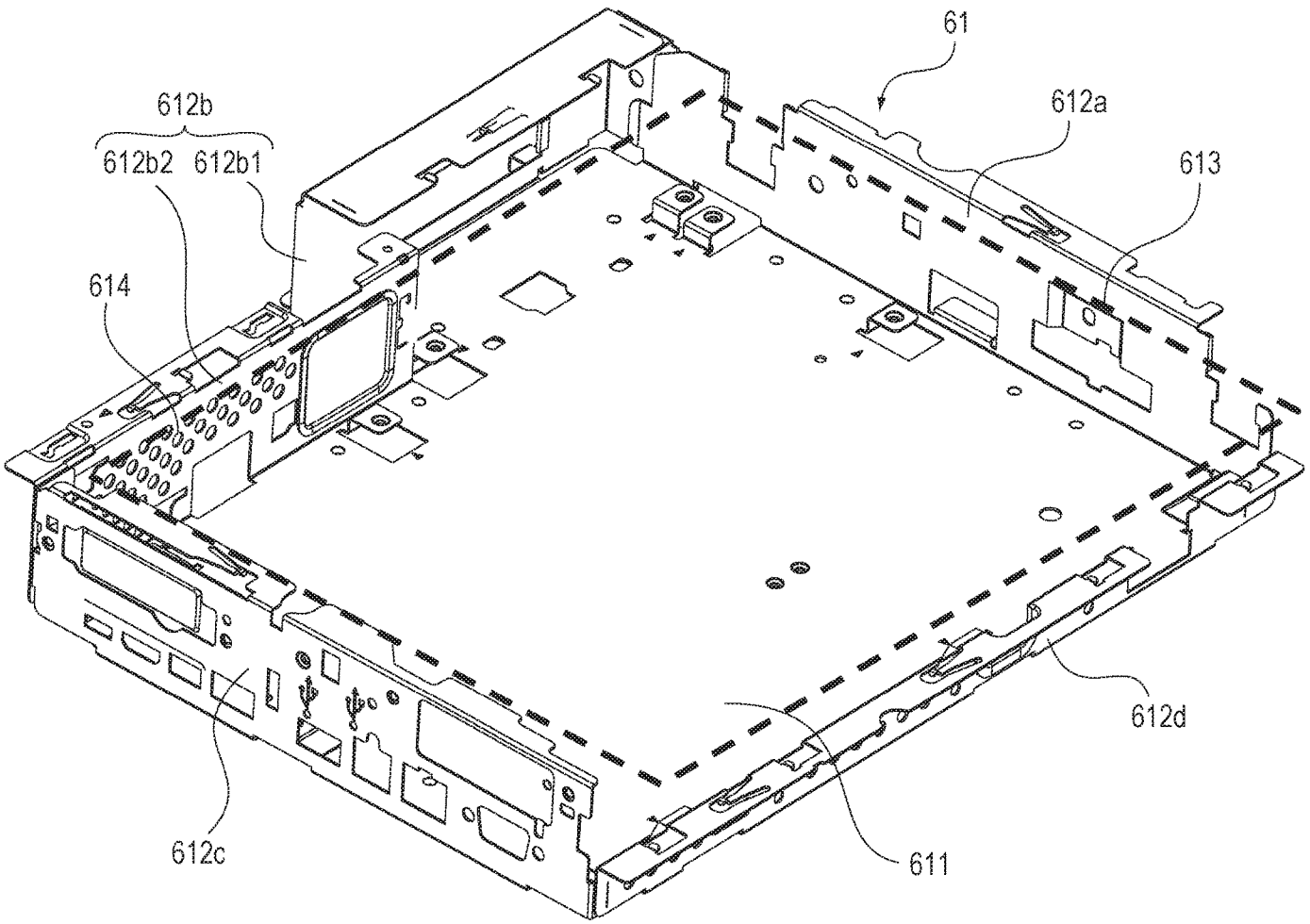
FIG. 3 is a perspective view illustrating a configuration of the shield case body of the first exemplary embodiment.

A configuration of a shield case 6 according to the present exemplary embodiment that covers the controller 60 will be described next with reference to FIGS. 3, 4A, and 4B. FIG. 3 is a perspective view illustrating a configuration of a housing 61 (a shield case body) included in the shield case 6.

Figure 4A:
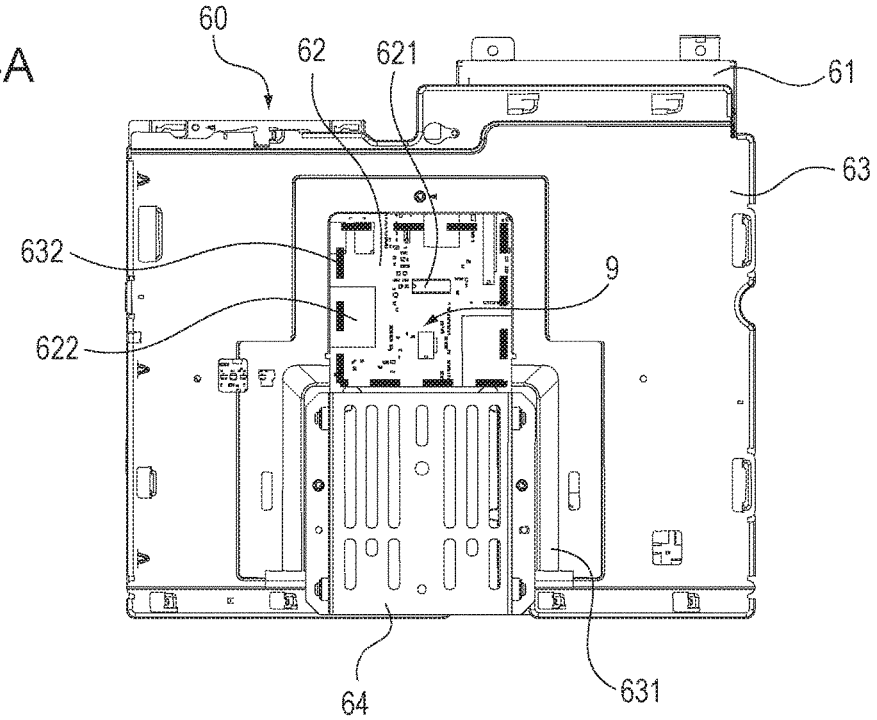
FIG. 4A is a front view illustrating a state in which a recording medium is mounted in a recessed portion provided on an external side of a top plate constituting the shield case of the first exemplary embodiment.
Figure 4B:
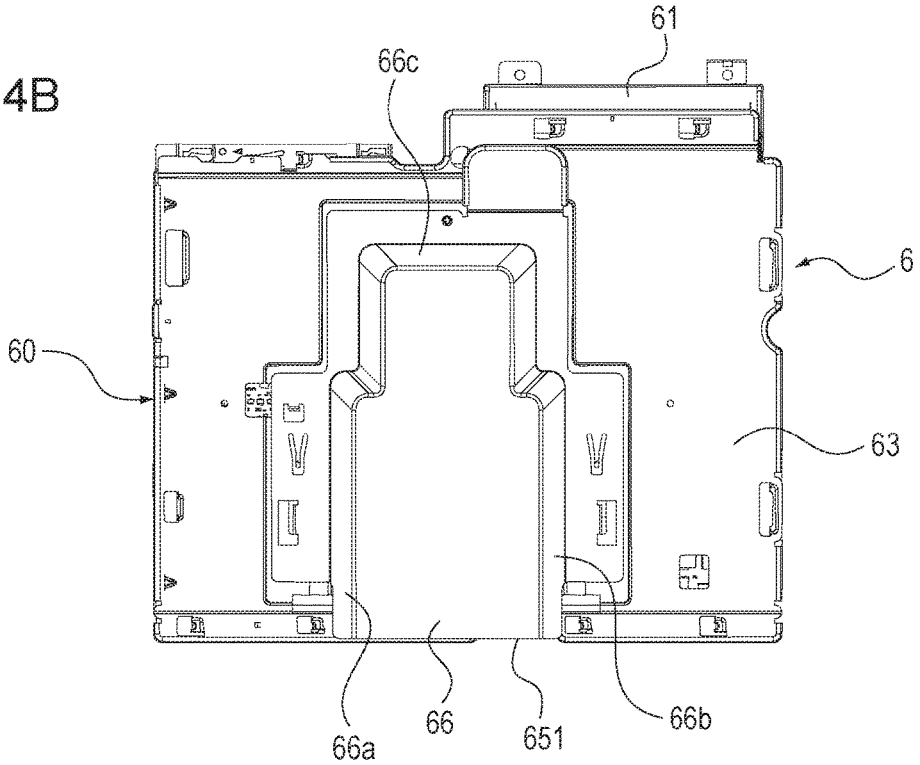
FIG. 4B is a front view illustrating a state in which a cover covering the recording medium mounted in the recessed portion provided on the external side of the top plate constituting the shield case of the first exemplary embodiment is mounted.

FIGS. 4A and 4B are front views illustrating a configuration of the controller 60 accommodated in the shield case 6 (to accommodate here means to provide space or housing for, to allow to operate or function, to provide or supply supporting means, elements or devices, to fit within the allowable space, etc.) FIG. 4A is a front view illustrating a state in which a hard disk drive (HDD) 64 serving as a storage medium is attached to a top plate 63 of the shield case 6 on an external side of the housing 61. FIG. 4B is a front view illustrating a state in which the HDD 64 attached to the top plate 63 of the shield case 6 on the external side of the housing 61 is covered with a cover 66.

The shield case 6, illustrated in FIGS. 3 to 6, accommodating the controller 60 is configured in the following manner. As illustrated in FIGS. 3 and 4A, the shield case 6 includes the housing 61 serving as an electro conductive shield case body that accommodates a circuit board 62 on which an electronic component 9 is mounted and that includes a first opening 613 for accommodating the circuit board 62. Furthermore, as illustrated in FIGS. 4A to 6, the shield case 6 is configured so as to include the electro conductive top plate 63, including a second opening 632, to be disposed to cover the first opening 613 of the housing 61.

The housing 61 serving as a circuit board accommodation portion illustrated in FIG. 3 is provided with a circuit board fixing surface (a circuit board installing surface) 611 for fixing the circuit board 62 on which the electronic component 9 illustrated in FIGS. 4A to 6 is mounted, and housing lateral sides 612*a* to 612*d* provided continuously from the circuit board fixing surface 611 at the four sides of the circuit board fixing surface 611.

Furthermore, the first opening 613 surrounded by the four housing lateral sides 612*a* to 612*d* is provided on the side opposite to the circuit board fixing surface 611. The housing lateral side 612*b* includes a housing lateral side 612*b*1 provided at one of the sides of the circuit board fixing surface 611, and a housing lateral side 612*b*2 (a first side wall portion) that is offset with respect to the housing lateral side 612*b*1 towards the inner side of the circuit board fixing surface 611.

A communication hole 614 (a third opening) serving as a vent hole formed of a plurality of through holes in order to communicate the inside of the housing 61 and the external air with each other is formed in the housing lateral side 612*b*2 serving as the first side wall portion provided in a portion of the housing 61 (the shield case body).

The circuit board 62 illustrated in FIG. 4A is fixed to the circuit board fixing surface 611 provided in the housing 61 through the first opening 613 illustrated in FIG. 3.

In recent years, while the reduction in size of the image forming apparatus is in progress, the reduction in space for the controller is also in progress; accordingly, reduction, to the extent possible, in the volume of the shield case accommodating the controller is used. Meanwhile, computer software is becoming highly functional as well. Accordingly, the amount of heat generated in a central processing unit (CPU) and the like that are mounted on the circuit board of the controller is becoming larger and larger.

Conventionally, the concept of accommodating all the electric components that are sources of noise together is the mainstream. Accordingly, the hard disk drive (HDD) 64 serving as the storage medium is accommodated in the housing 61 together with the electronic component 9, such as the CPU 622. However, the operation guarantee temperature of the HDD 64 may become an issue when reducing the space for the controller 60.

The operation guarantee temperature of the HDD 64 is about 50° C. and the operation guarantee temperature of the CPU 622 and the like is 80° C. Accordingly, the operation temperature of the HDD 64 is to be maintained lower than the operation temperature of the CPU 622 and the like.

Accordingly, when the space for the controller 60 is reduced, a situation in that the temperature inside the housing 61 reaches the limit of the operation guarantee temperature of the HDD 64 occur due to the heat generated by the CPU 622 and the like.

Figure 5:
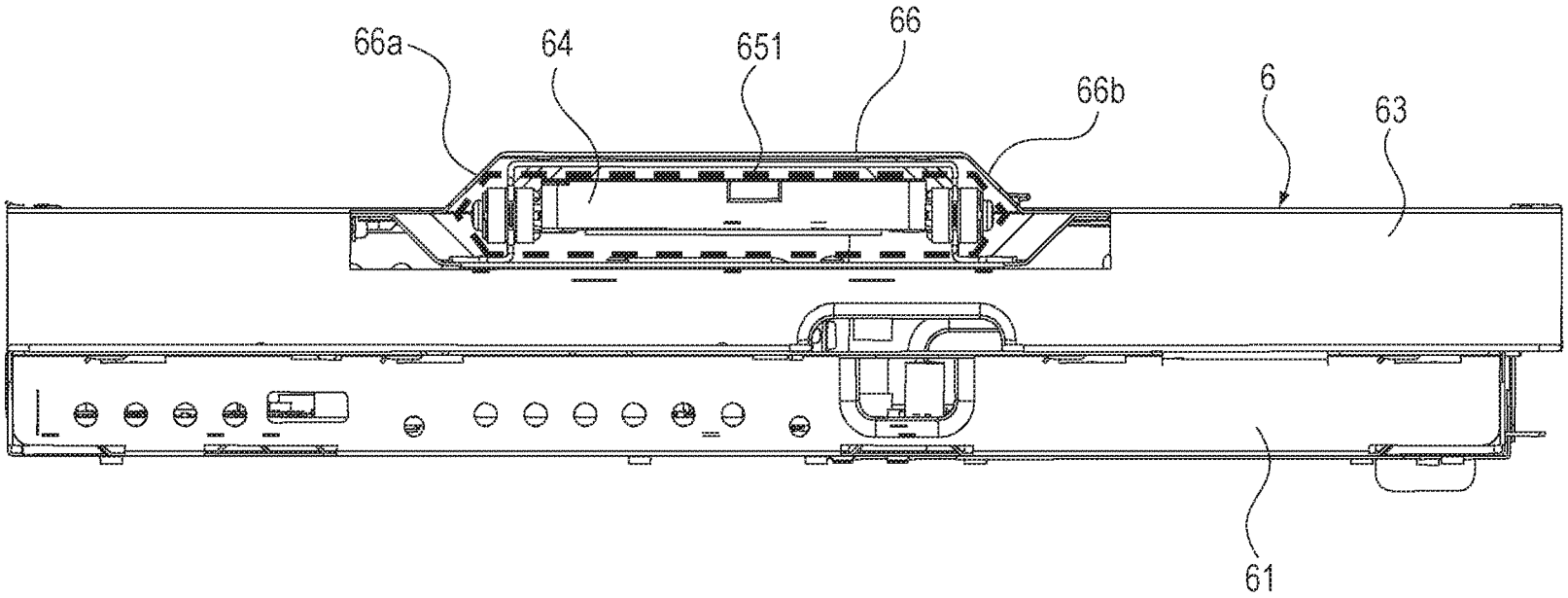
FIG. 5 is a bottom view illustrating a configuration of the controller covered with the shield case of the first exemplary embodiment.

Accordingly, in the present exemplary embodiment, as illustrated in FIG. 5, the HDD 64 is disposed on the top plate 63 and on the external side of the housing 61. In other words, the top plate 63 functions as a partitioning portion that separates the HDD 64 and the circuit board 62. FIG. 4A illustrates a state in which the HDD 64 is mounted on the top plate 63 and on the external side of the housing 61. The top plate 63 is configured to cover the first opening 613 illustrated in FIG. 3 and is mounted on the housing 61 after the circuit board 62 has been fixed to the circuit board fixing surface 611 of the housing 61.

In the top plate 63, a recessed portion 631 is formed so that the portion where the HDD 64 is provided is recessed towards the circuit board fixing surface 611 side (the shield case body side) of the housing 61 with respect to the other surfaces. The HDD 64 is fixed to the external side of the housing 61 that is inside the recessed portion 631 provided in the top plate 63.

The recessed portion 631 is provided in a portion of the top plate 63, and the HDD 64 is fixed inside the recessed portion 631. With the above, the HDD 64 is disposed on the external side of the housing 61. With the above, an increase in the overall thickness of the shield case 6 can be suppressed and the controller 60 can save space.

As illustrated in FIG. 4A, the top plate 63 is provided with the second opening 632. The HDD 64 is electrically connected to a connector 621 of the circuit board 62 that is connected on the circuit board fixing surface 611 side with a signal wire (not shown) through the second opening 632 provided in the top plate 63.

In the present exemplary embodiment, since the HDD 64 is disposed in the top plate 63 and on the external side of the housing 61, the effect of the temperature rise exerted on the HDD 64, the temperature rise occurring on the inner side of the top plate 63 being caused by the CPU 622 and the like that are mounted on the circuit board 62 provided on the circuit board fixing surface 611 of the housing 61, can be suppressed.

In the present exemplary embodiment, the HDD 64 that is a noise source and the signal wire connected to the HDD are disposed on the external side of the top plate 63, and the second opening 632 for connecting the signal wire is provided in the top plate 63. The present exemplary embodiment is configured in the following manner to deal with the noise sources.

As illustrated in FIG. 4B, the electro conductive cover 66 that collectively accommodates and covers the HDD 64 disposed in the top plate 63 and on the external side of the housing 61, the signal wire (not shown) that connects the HDD 64 and the connector 621 of the circuit board 62 to each other, and the second opening 632 provided in the top plate 63 is provided.

FIG. 4B illustrates a state in which the cover 66 that collectively accommodates and covers the HDD 64, the signal wire (not shown), and the second opening 632 is mounted after, from the state illustrated in FIG. 4A, the circuit board 62 and the HDD 64 are connected to each other with the signal wire.

The cover 66 is formed in a shape that can collectively accommodate and cover the HDD 64, the signal wire (not shown) that connects the HDD 64 and the circuit board 62 to each other, and the second opening 632 provided in the top plate 63. Furthermore, as illustrated in FIG. 4B, the cover 66 is connected and fixed to the top plate 63 with lateral sides 66*a* to 66*c* (second side wall portion) that are a portion of the cover 66 and that are provided in the three sides of the cover 66.

No lateral side is provided in one side of the cover 66 of the present exemplary embodiment and an opening 651 (a fourth opening) is provided therein. The opening 651 (the fourth opening) is formed in a portion of the lateral side (the second side wall portion) of the cover 66 of the present exemplary embodiment.

The circuit board 62 illustrated in FIG. 4A that is fixed to the circuit board fixing surface 611 of the housing 61, and the first opening 613 of the housing 61 are covered by the top plate 63. Furthermore, the second opening 632 provided in the top plate 63, the HDD 64 accommodated inside the recessed portion 631 that is provided in the top plate 63, and the signal wire (not shown) connecting the HDD 64 and the circuit board 62 to each other are covered by the cover 66.

The housing 61, the top plate 63, and the cover 66 of the present exemplary embodiment are formed of electro conductive members (for example, electrogalvanized steel plates). Accordingly, the housing 61, the top plate 63, and the cover 66 function as the shield case 6 that shields the electromagnetic noise.

For example, the CPU 622 and the crystal resonator therearound, and the HDD 64 and the signal wire thereof that are elements mounted on the circuit board 62 illustrated in FIG. 4A generate electromagnetic noises. In the present exemplary embodiment, the housing 61, the top plate 63, and the cover 66 function as the shield case 6. Accordingly, effect of the electromagnetic noises exerted on the external side of the image forming apparatus 10 can be suppressed.

Air Duct

Figure 6:
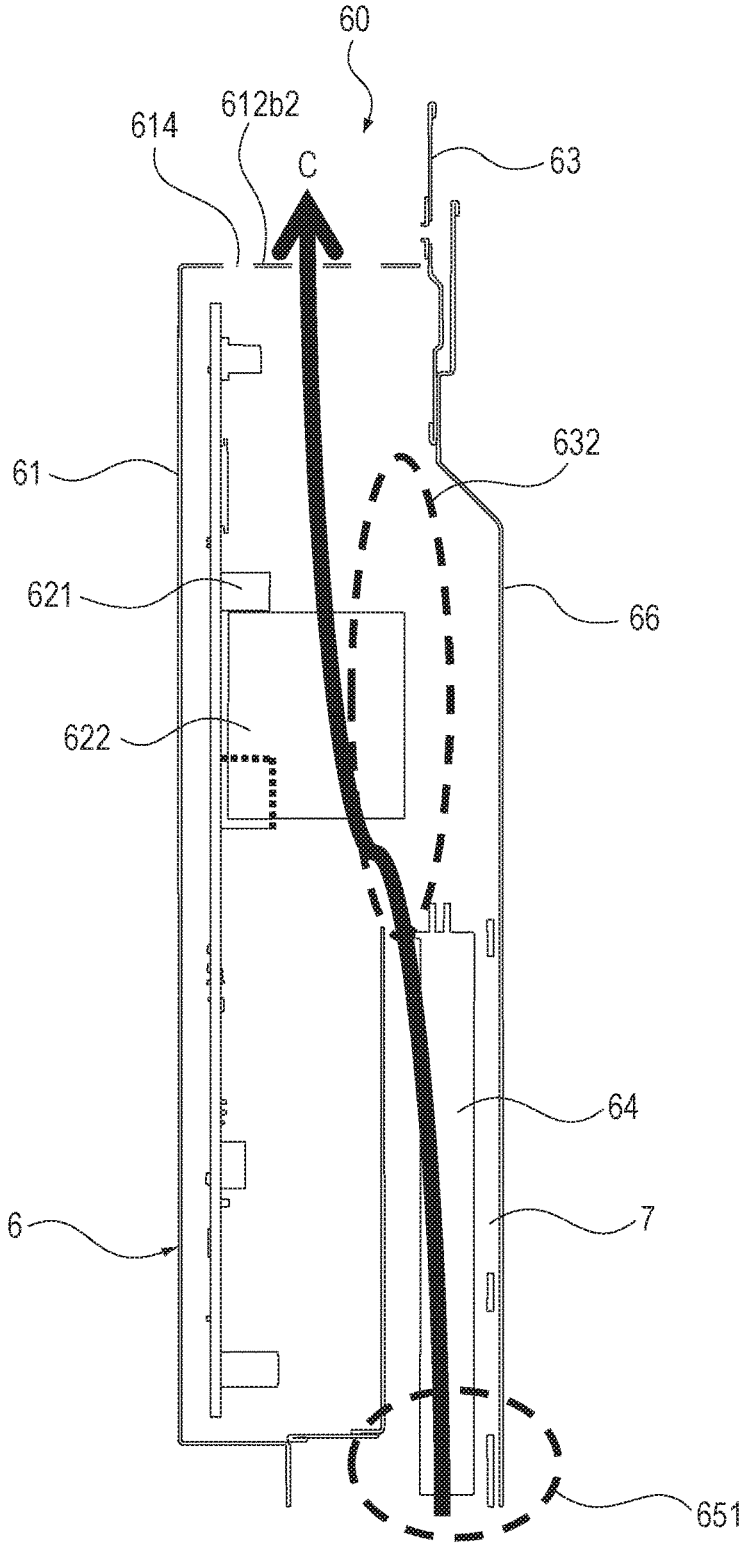
FIG. 6 is a cross-sectional view illustrating the configuration of the controller covered with the shield case of the first exemplary embodiment.

Referring next to FIGS. 5 and 6, a configuration of the cover 66 of the present exemplary embodiment that also functions as an air duct 7 of the controller 60 will be described.

FIG. 5 is a bottom view illustrating a configuration of the controller 60 covered by the shield case 6 constituted by the housing 61, the top plate 63, and the cover 66. FIG. 6 is a cross-sectional view illustrating the configuration of the controller 60 covered by the shield case 6 constituted by the housing 61, the top plate 63, and the cover 66.

As illustrated in FIG. 3, the communication hole 614 formed of the plurality of through holes is provided in the housing lateral side 612*b*2 provided in one of the sides of the housing 61.

Furthermore, as illustrated in FIG. 5, the opening 651 of the cover 66 that is in communication with the external air is formed on the undersurface side of the controller 60.

The communication hole 614 formed of the plurality of through holes provided in the housing lateral side 612*b*2 illustrated in FIG. 3, the second opening 632 provided in the top plate 63 illustrated in FIG. 4A, and the opening 651 of the cover 66 illustrated in FIG. 5 are provided. With the above, as illustrated in FIG. 6, an air flow path C that is in communication with the external air can be provided inside the controller 60 covered by the shield case 6 configured of the housing 61, the top plate 63, and the cover 66.

The external air that passes through the air flow path C flows in through the opening 651 of the cover 66, passes through the air duct 7 formed between the cover 66 and the top plate 63, and cools the HDD 64. Subsequently, the air passes through the inside of the housing 61 formed by the top plate 63 and the housing 61 from the second opening 632 provided in the top plate 63. Then, the air is discharged into the external air through the communication hole 614 formed of the plurality of through holes provided in the housing lateral side 612*b*2.

The external air passing through the air flow path C gradually flows from a portion having a lower temperature to a portion having a higher temperature and is ultimately discharged into the external air.

In the present exemplary embodiment, the storage medium, such as the HDD 64, is attached to the external side of the top plate 63 of the shield case 6. With the above, the effect of the temperature rise exerted on the HDD 64, the temperature rise occurring on the inner side of the top plate 63 being caused by the CPU 622 and the like that are mounted on the circuit board 62 provided on the circuit board fixing surface 611 of the housing 61, can be suppressed.

Furthermore, the signal wire (not shown) that connects the HDD 64 and the circuit board 62 to each other, and the second opening 632 provided in the top plate 63, illustrated in FIG. 4A, to pass the signal wire therethrough are covered by the cover 66 formed of an electro conductive member. With the above, shielding performance against the electromagnetic noise can be obtained.

Furthermore, the communication hole 614 that communicates the inside of the housing 61 and the external air is provided in the housing lateral side 612*b*2 of the housing 61. Furthermore, the second opening 632 that is in communication of the inside of the housing 61 is provided in the top plate 63. Furthermore, the air duct 7 that is in communication with the second opening 632 is provided between the top plate 63 and the cover 66. Furthermore, the opening 651 that communicates the air duct 7 and the external air is provided in the cover 66. With the above, the air flow path C in which the external air passes through the inside of the housing 61 from the opening 651 of the cover 66 and through the air duct 7, the second opening 632, and the communication hole 614 can be formed.

The communication hole 614 is provided in the housing 61 and is disposed above the hard disk drive (HDD) 64. The opening 651 is disposed below the second opening 632. Furthermore, the HDD 64 is disposed inside the duct 7. With the above configuration, the heat of the circuit board 62 contained in the housing 61 is released through the communication hole 614, and with the natural convection caused by the above, the external air is drawn in from the opening 651. The external air drawn in from the opening 651 cools the HDD 64. Furthermore, the external air drawn in from the opening 651 can be discharged from the communication hole 614 through the second opening 632 by natural convection.

Furthermore, the recessed portion 631 that protrudes towards the internal side of the housing 61 is formed in a portion of the top plate 63 that covers the inside of the housing 61, and the HDD 64 is accommodated in and attached to the recessed portion 631. With the above, the entire thickness of the shield case 6 covering the controller 60 can be reduced. With the above, the size of the control device can be reduced.

Furthermore, the shield case 6 that accommodates the controller 60 is provided in the image forming apparatus 10. With the above, the effect of the temperature rise exerted on the HDD 64 attached to the external side of the top plate 63, the temperature rise occurring on the inner side of the top plate 63 of the shield case 6 being caused by the CPU 622 and the like that are mounted on the circuit board 62 provided on the circuit board fixing surface 611 of the housing 61, can be suppressed.

Furthermore, the communication hole 614 provided in the housing lateral side 612*b*2 of the housing 61 of the shield case 6 is disposed on the upper side of the image forming apparatus 10. Moreover, the opening 651 of the cover 66 is disposed on the lower side of the image forming apparatus 10. With the above, the external air that has entered through the opening 651 of the cover 66 flows into the air duct 7 formed between the cover 66 and the top plate 63 and cools the HDD 64. Furthermore, the air flows through the inside of the housing 61 formed between the top plate 63 and the housing 61 through the second opening 632 of the top plate 63 and cools the CPU 622 and the like that are mounted on the circuit board 62. Subsequently, natural convection that discharges the external air from the communication hole 614 provided in the housing lateral side 612*b*2 of the housing 61 can be created.

Second Exemplary Embodiment

Figure 7:
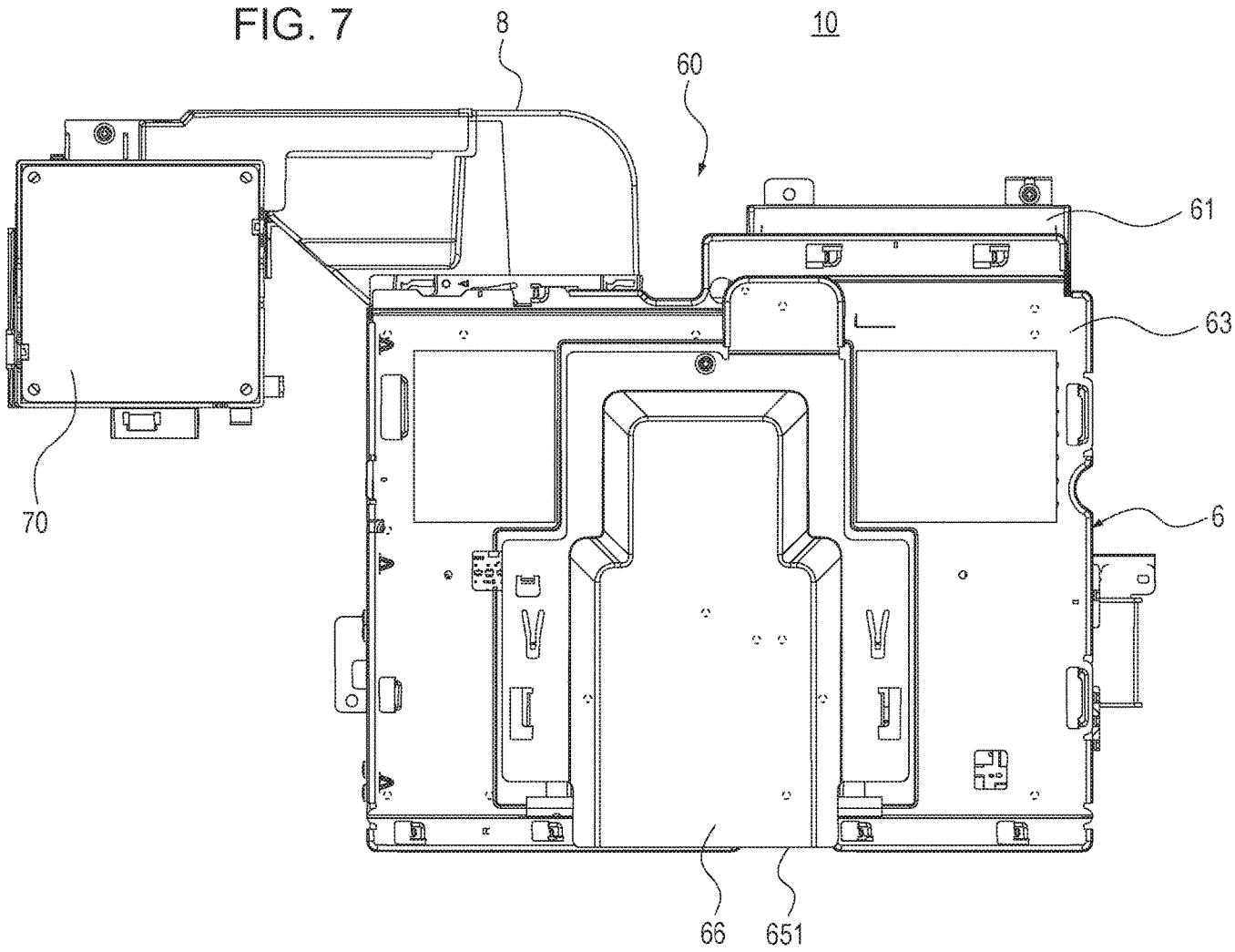
FIG. 7 is a front view illustrating a state in which the controller covered with a shield case of a second exemplary embodiment according to the aspect of the embodiments is attached to the image forming apparatus.

Referring to FIG. 7, a configuration of an image forming apparatus according to a second exemplary embodiment provided with a shield case according to the present disclosure will be described. Note that description of members that are configured in a similar manner to the members of the first exemplary embodiment will be omitted and will be attached with the same reference numeral, and even if the reference numerals of the members are different, the same member name will be given.

FIG. 7 is a front view illustrating a state in which the controller covered with a shield case of a second exemplary embodiment according to the present disclosure is attached to the image forming apparatus. As illustrated in FIG. 7, the controller 60 is attached onto a wall surface (a third side wall portion) such that the opening 651 (the fourth opening) of the cover 66 is oriented towards the lower side (bottom surface side) of the body of the image forming apparatus 10.

With the above, the communication hole 614 (the third opening) formed of the plurality of through holes provided in the housing lateral side 612*b*2 illustrated in FIG. 3 is attached onto the wall surface (the third side wall portion) so as to be oriented towards the upper side (top surface side) of the body of the image forming apparatus 10.

With the above, an airflow crated by natural convection is formed in the air flow path C illustrated in FIG. 6. Furthermore, in the present exemplary embodiment, the communication hole 614 formed of the plurality of through holes is provided with an air blowing fan 70 through an air blowing duct 8.

With the above, by rotationally driving the air blowing fan 70, cool air is sent through the air blowing duct 8 from the communication hole 614 formed of the plurality of through holes provided in the housing lateral side 612*b*2 illustrated in FIG. 3 in a direction opposite to the arrow of the air flow path C illustrated in FIG. 6. By so doing, the inside of the controller 60 can be actively cooled. Other configurations are similar to the configurations of the first exemplary embodiment, and a similar effect can be obtained.

The aspect of the embodiments is capable of preventing a storage medium that has a lower limit temperature than those of other elements from malfunctioning.

While the aspect of the embodiments has been described with reference to exemplary embodiments, it is to be understood that the aspect of the embodiments is not limited to the disclosed exemplary embodiments. The scope of the following claims is to be accorded the broadest interpretation so as to encompass all such modifications and equivalent structures and functions.

This application claims the benefit of Japanese Patent Application No. 2015-220867, filed Nov. 11, 2015, which is hereby incorporated by reference herein in its entirety.

What is claimed is:

1. An image forming apparatus, comprising:

an image-forming unit configured to form an image;

a circuit board on which an electronic component is mounted;

a storage medium configured to store information;

a signal wire configured to connect the circuit board and the storage medium for sending a signal;

an electro conductive box portion including, a first accommodate portion configured to form a space to accommodate the circuit board;

a second accommodate portion that is provided to overlap with the first accommodate portion in a thickness direction of the circuit board, configured to form a space to accommodate the storage medium;

a partitioning portion configured to separate the space to accommodate the circuit board and the space to accommodate the storage medium, form the space to accommodate the circuit board together with the first accommodate portion and form the space to accommodate the storage medium together with the second accommodate portion;

a first vent hole portion provided in the first accommodate portion and disposed over the storage medium, the first vent hole being in communication with external air;

a second vent hole portion provided in the second accommodate portion for communicating with the external air at a portion under the storage medium; and a third vent hole portion provided, over the partitioning portion, between the first vent hole portion and the second vent hole portion and upper to the storage medium, configured to communicate the space to accommodate the circuit board with the space to accommodate the storage medium, and insert the signal wire.

2. The image forming apparatus according to claim 1, wherein the storage medium is disposed in a path that guides the external air that has flowed in from the second vent hole to the third vent hole portion.

3. The image forming apparatus according to claim 1, wherein the circuit board is disposed in a path formed between the third vent hole portion and the first vent hole.

4. The image forming apparatus according to claim 1, wherein the first accommodate portion includes an installing surface on which the circuit board is disposed, a lateral side wall that stands erect from a periphery of the installing surface, and an opening provided at a position that opposes the installing surface, wherein the partitioning portion that is disposed so as to cover the opening and in which the third vent hole portion is formed.

5. The image forming apparatus according to claim 1, wherein the second accommodate portion includes an electro conductive cover portion that is attached so as to cover the storage medium, the third vent hold portion, and the signal wire.

6. The image forming apparatus according to claim 5, further comprising a duct portion that is formed with the partitioning portion and the cover portion, the duct portion passing the external air between the first vent hole and the second vent hole through the third vent hole portion.

7. The image forming apparatus according to claim 1, wherein a recessed portion is formed in the partitioning portion at an area corresponding to where the storage medium is accommodated.

8. The image forming apparatus according to claim 1, wherein the first vent hole portion is provided so as to be oriented towards an upper surface side of a body of the image forming apparatus, and the second vent hole portion is provided so as to be oriented towards a bottom surface side of the body of the image forming apparatus.

9. An image forming apparatus comprising:

an image-forming unit configured to form an image;

a circuit board on which an electronic component is mounted;

a storage medium configured to store information;

a signal wire configured to connect the circuit board and the storage medium for sending a signal;

an electro conductive box portion including, a first accommodate portion configured to form a space to accommodate the circuit board;

a second accommodate portion that is provided to overlap with the first accommodate portion in a thickness direction of the circuit board, configured to form a space to accommodate the storage medium;

a partitioning portion configured to separate the space to accommodate the circuit board and the space to accommodate the storage medium, form the space to accommodate the circuit board together with the first accommodate portion and form the space to accommodate the storage medium together with the second accommodate portion;

a first vent hole portion provided in the first accommodate portion for communicating with external air;

a second vent hole portion provided in the second accommodate portion for communicating with the external air;

a third vent hole portion provided, over the partitioning portion, between the first vent hole portion and the second vent hole portion, configured to communicate the space to accommodate the circuit board with the space to accommodate the storage medium, and insert the signal wire; and a fan configured to cause an external air to flow into a box portion either from the first vent hole portion or the second vent hole portion and send the external air to the other one of the first vent hole portion or the second vent hole portion through the third vent hole portion.

10. The image forming apparatus according to claim 9, wherein the third vent hole portion is provided at a position upper than the storage medium and the second vent hole portion is provided at a position lower than the storage medium, and wherein the storage medium is disposed in a path that guides the external air that has flowed in from the second vent hole portion to the third vent hole portion.

11. The image forming apparatus according to claim 10, further comprising a duct portion that is formed with the partitioning; portion and the cover portion, the duct portion passing the external air between the first vent hole portion and the second vent hole portion through the third vent hole portion.

12. The image forming apparatus according to claim 9, wherein the first vent hole portion is provided at a position upper than the third vent hole portion, and wherein the electronic component is disposed in a path formed between the third vent hole portion and the first vent hole portion.

13. The image forming apparatus according to claim 9, wherein the first accommodate portion including an installing surface on which the circuit board is disposed, a lateral side wall that stands erect from a periphery of the installing surface, and an opening provided at a position that opposes the installing surface, and wherein the partitioning portion that is disposed so as to cover the opening and in which the third vent hole portion is formed.

14. The image forming apparatus according to claim 9, wherein the second accommodate portion includes an electro conductive cover portion that is attached so as to cover the storage medium, the third vent hole portion, and the signal wire.

15. The image forming apparatus according to claim 9, wherein a recessed portion is formed in the first partitioning portion at an area corresponding to where the storage medium is accommodated.

16. The image forming apparatus according to claim 9, wherein the first vent hole portion is provided so as to be oriented towards an upper surface side of a body of the image forming apparatus, and the second vent hole portion is provided so as to be oriented towards a bottom surface side of the body of the image forming apparatus.

17. An image forming apparatus, comprising:

an image-forming unit configured to form an image;

a circuit board on which a CPU is mounted;

a hard disc drive configured to store information;

a signal wire configured to connect the circuit board and the hard disc drive for sending a signal;

an electro conductive box portion including, a first accommodate portion configured to form a space to accommodate the circuit board;

a second accommodate portion that is provided to overlap with the first accommodate portion in a thickness direction of the circuit board, configured to form a space to accommodate the hard disc drive;

a partitioning portion configured to separate the space to accommodate the circuit board and the space to accommodate hard disc drive, form the space to accommodate the circuit board together with the first accommodate portion and form the space to accommodate the hard disc drive together with the second accommodate portion;

a first vent hole portion provided in the electro conductive box and disposed over the CPU in a vertical direction, the first vent hole portion being in communication with external space of the electro conductive box;

a second vent hole portion provided in the electro conductive box and disposed under the hard disc drive in the vertical direction, the second vent hole portion being in communication with external space of the electro conductive box; and a third vent hole portion provided, between the first vent hole portion and the second vent hole portion and at a position over the hard disc drive in the vertical direction, configured to communicate the space to accommodate the circuit board with the space to accommodate the hard disc drive, and insert the signal wire, wherein the CPU disposed over the hard disc drive in the vertical direction.

18. The image forming apparatus according to claim 17, wherein the third vent hole provided overlapping with the CPU in the vertical direction.

19. The image forming apparatus according to claim 17, wherein the hard disc drive is disposed in a path that guides an external air that has flowed in from the second vent hole to the third vent hole portion.

20. The image forming apparatus according to claim 17, wherein the CPU of the circuit board is disposed in a path formed between the third vent hole portion and the first vent hole.

21. The image forming apparatus according to claim 17, wherein the first accommodate portion includes an installing surface on which the circuit board is disposed, a lateral side wall that stands erect from a periphery of the installing surface, and an opening provided at a positon that opposes the installing surface, wherein the partitioning portion that is disposed so as to cover the opening and in which the third vent hole portion is formed.

22. The image forming apparatus according to claim 17, wherein the second accommodate portion includes an electro conductive cover portion that is attached so as to cover the hard disc drive, the third vent hold portion, and the signal wire.

23. The image forming apparatus according to claim 22, further comprising a duct portion that is formed with the partitioning portion and the electro conductive cover portion, the duct portion passing the external air between the first vent hole and the second vent hole through the third vent hole portion.

24. The image forming apparatus according to claim 17, wherein a recessed portion is formed in the partitioning portion at an area corresponding to where the hard disc drive is fixed.

25. An image forming apparatus comprising:

an image-forming unit configured to form an image;

a circuit board on which a CPU is mounted;

a hard disc drive configured to store information;

a signal wire configured to connect the circuit board and the hard disc drive for sending a signal;

an electro conductive box portion including, a first accommodate portion configured to form a space to accommodate the circuit board;

a second accommodate portion that is provided to overlap with the first accommodate portion in a thickness direction of the circuit board, configured to form a space to accommodate the hard disc drive;

a partitioning portion configured to separate the space to accommodate the circuit board and the space to accommodate the hard disc drive, form the space to accommodate the circuit board together with the first accommodate portion and form the space to accommodate the hard disc drive together with the second accommodate portion;

a first vent hole portion provided in the electro conductive box to communicate with an external space of the electro conductive box and the space to accommodate the circuit board;

a second vent hole portion provided in the electro conductive box to communicate with the external space of the electro conductive box and the space to accommodate the hard disc drive;

a third vent hole portion provided, between the first vent hole portion and the second vent hole portion and at a position over the hard disc drive in a vertical direction, configured to communicate the space to accommodate the circuit board with the space to accommodate the hard disc drive, and insert the signal wire; and a fan configured to cause an external air to flow into the electro conductive box either from the first vent hole portion or the second vent hole portion and send the external air to the other one of the first vent hole portion or the second vent hole portion through the third vent hole portion wherein the CPU disposed over the hard disc drive in the vertical direction.

26. The image forming apparatus according to claim 25, wherein the third vent hole portion is provided at a position upper than the hard disc drive and overlapping with the CPU, wherein the second vent hole portion is provided at a position lower than the hard disc drive, and wherein the hard disc drive is disposed in a path that guides the external air that has flowed in from the second vent hole portion to the third vent hole portion.

27. The image forming apparatus according to claim 25, wherein the first vent hole portion is provided at a position upper than the third vent hole portion, and wherein the CPU is disposed in a path formed between the third vent hole portion and the first vent hole portion.

28. The image forming apparatus according to claim 25, wherein the first accommodate portion including an installing surface on which the circuit board is disposed, a lateral side wall that stands erect from a periphery of the installing surface, and an opening provided at a positon that opposes the installing surface, and wherein the partitioning portion that is disposed so as to cover the opening and in which the third vent hole portion is formed.

29. The image forming apparatus according to claim 25, wherein the second accommodate portion includes an electro conductive cover portion that is attached so as to cover the hard disc drive, the third vent hole portion, and the signal wire.

30. The image forming apparatus according to claim 29, further comprising a duct portion that is formed with the partitioning portion and the electro conductive cover portion, the duct portion passing the external air between the first vent hole portion and the second vent hole portion through the third vent hole portion.

31. The image forming apparatus according to claim 25, wherein a recessed portion is formed in the partitioning portion at an area corresponding to where the hard disc drive is fixed.

32. The image forming apparatus comprising:

an image-forming unit configured to form an image;

a circuit board on which a CPU is mounted;

a hard disc drive configured to store information;

a signal wire configured to connect the circuit board and the hard disc drive for sending a signal;

a shield case configured to accommodate the circuit board, the hard disc drive, and the signal wire, the shield case including a partitioning portion configured to separate a space for accommodating the circuit board from a space for accommodating the hard disc drive in a thickness direction of the circuit board;

a first vent hole portion provided to the shield case in such a manner that the first vent hole portion is located at a position over the CPU in a vertical direction to allow an external space of the shield case and the space for accommodating the circuit board to communicate with each other;

a second vent hole portion provided under the hard disc drive in the vertical direction to allow the external space of the shield case and the space for accommodating the hard disc drive to communicate with each other, wherein the CPU is mounted on the circuit board at a position over the hard disc drive in the vertical direction, and wherein the signal wire passes a space over the partitioning portion in the vertical direction to electronically connect the circuit board and the hard disc drive.

33. The image forming apparatus according to claim 32, wherein the shield case includes an installing surface on which the circuit board is disposed, a lateral side wall that stands erect from a periphery of the installing surface, and an opening portion provided at a positon that opposes the installing surface, wherein the partitioning portion that is disposed so as to cover the opening portion and in which the third vent hole portion is formed is provided with the hard disc drive in such a manner that the hard disc drive is fixed at a surface opposite to a surface covering the opening in a thickness direction of the circuit board.

* * * * *